United States Patent [19]

Curington et al.

[11] Patent Number: 4,798,243

[45] Date of Patent: Jan. 17, 1989

[54] PACKER WITH ELECTRICAL CONDUIT BYPASS

[75] Inventors: Alfred R. Curington, The Woodlands; Napoleon Arizmendi, Houston, both of Tex.

[73] Assignee: Baker Hughes Incorporated, Houston, Tex.

[21] Appl. No.: 119,714

[22] Filed: Nov. 12, 1987

[51] Int. Cl.[4] ..... E21B 33/128; E21B 33/129

[52] U.S. Cl. ..... 166/65.1; 166/106; 166/120; 166/134

[58] Field of Search ..... 166/120, 65.1, 106, 166/134, 72, 242

[56] References Cited

U.S. PATENT DOCUMENTS

| | | | |
|---|---|---|---|
| 2,253,092 | 8/1941 | Pranger | 166/65.1 X |
| 2,739,650 | 3/1956 | Hill | 166/106 |
| 3,196,948 | 7/1965 | Dye | 166/106 X |
| 3,899,631 | 8/1975 | Clark | 166/65.1 |
| 4,022,273 | 5/1977 | Marathe | 166/66.4 |
| 4,387,767 | 6/1983 | Read | 166/72 |
| 4,606,410 | 8/1986 | Becker et al. | 166/117.5 X |

OTHER PUBLICATIONS

"Model 'MPL' Packer—(Size $51\times4\frac{1}{2}$) With Cable By-Pass and Optional Port For 'VR' or 'AGV' Valve", Baker Packers, Dec. 18, 1986, pp. 1-14.

A drawing of Baker's Model 'D' Pack-off Tubing Hanger With Cable Bypass, Oct. 28, 1982.

*Primary Examiner*—Hoang C. Dang

*Attorney, Agent, or Firm*—Hubbard, Thurman, Turner & Tucker

[57] ABSTRACT

A packer for a subterranean well conduit providing an electrical conduit bypass comprises a top sub having a first eccentric bore connectable between a tubing string and a mandrel and a second eccentric passage sealingly receiving an electrical conduit. A tubular body assembly is shearably connected to the top sub and mounts an annular packing element, an annular cylinder and piston unit and an annular slip and cone assemblage in axially stacked, abutting relationship. A support block secured to the lower end of the mandrel supports the electrical conduit and secures the lower cone against relative movement so that extension of said cylinder and piston effects setting of the packer. Upward movement of the top sub effects unsetting and retrieval of the packer.

8 Claims, 7 Drawing Sheets

PACKER WITH ELECTRICAL CONDUIT BYPASS

BACKGROUND OF THE INVENTION

1. Field of the Invention

This invention relates to a packer for subterranean wells and particularly to a packer for accommodating various sizes of electrical cables in bypass relationship to the packer.

2. Summary of the Prior Art

In many subterranean wells it is desirable to mount an electric submersible pump in the portion of the well casing that is adjacent to a producing formation. Such pump may be conveniently suspended in the well by a packer, but a problem arises in supplying electrical power to the submersible pump by an electrical cable which does not pass through the bore of the tubing string which is connected to the top end of the packer and which is in fluid communication with the discharge end of the pump. Passing the cable through the bore of the tubing string obviously seriously reduces the fluid passage area for production fluid.

Accordingly, packers have been developed in the past wherein the electric cable for supplying energy to a submersible pump has traversed the body of a packer in eccentric relationship to a centrally mounted mandrel which communicates directly with the tubing string and the output of the submersible pump. A packer of this general type has been sold by BAKER PACKERS DIVISION of Houston, Tex. under the tradename of "BAKER MODEL "D" PACKOFF TUBING HANGER WITH CABLE BYPASS".

While this tool is completely functional, it suffers from the disadvantage that it will only efficiently accommodate one size of tubing string bore and one size of electrical cable. If it is desired to utilize a tubing string having a larger bore or larger cable than that for which the aforementioned packoff tubing hanger was designed, then it becomes necessary to redesign and manufacture a substantial number of components of the packoff tubing hanger in order to efficiently accommodate the revised sizes of either the bore of the tubing string or the diameter of the electrical cable.

SUMMARY OF THE INVENTION

It is, accordingly, an object of this invention to provide a retrievable packer for a subterranean well having a cable bypass which may be conveniently modified to accommodate different size bores of tubing string to which the packer is connected, and/or different size electrical cables, through revision of only two or three components of the packer assemblage, thus substantially reducing the cost of manufacture of any packer having non-standard tubing bore dimensions and/or non-standard electrical cable dimensions.

The objects of this invention are accomplished by the mounting of all of the active packing elements of the packer in a cylindrical shell configuration, and then effecting the connection between the tubing string above and below the packer by a mandrel sized to accommodate the internal bore dimensions of the tubing string to be used with the packer, which mandrel is supported within the packer assemblage by as few as two components. In similar fashion, the bypass for an electrical cable is provided by an eccentric hole provided in each of the two components requiring modification to accommodate the selected mandrel.

The major components of the cylindrical packer assemblage comprises a top sub having a cylindrical outer configuration but defining an eccentrically disposed passage having means at its upper end for connection to a tubing string and means at its lower end for connection to a mandrel which extends downwardly through the entire length of the packer. The top sub also defines an eccentric passage for receiving an electrical cable of the desired size. This passage is preferably connected at its upper end to a conventional cable penetration assembly by which a sealed relationship is achieved between the exterior of the electrical cable and the bore of the cable passage extending through the top sub.

The top sub is detachably secured to the upper end of an upper tubular body portion by a conventional shearable ring. Such upper body portion is of a diameter approaching that of the internal bore of the well conduit within which the cable bypass packer is to be mounted. The upper body portion is in turn connected to a body connector sub and this sub is connected to the top end of a lower tubular body portion. An upper mandrel support block may be mounted within the upper body portion and has longitudinal eccentric passages for respectively receiving the mandrel and the electrical cable.

The annular elastomeric packing elements commonly employed in packers and the annular slip and cone assemblage are mounted in surrounding concentric relationship respectively to the upper body portion and the lower tubular body portion.

The only other support provided for the mandrel and the electrical cable is provided by a generally cylindrical lower support block which is formed in two radially split pieces which are secured together in clamping relationship to the mandrel. The exterior of the cylindrical support block engages collet heads formed on the bottom end of the lower tubular body portion and maintains such collet heads in locking relationship with respect to an actuator assemblage for the lower slip cone. Thus, to accommodate a different size mandrel or a different size passage for the electrical conduit, it is only necessary to select a mandrel of the desired size and to redesign the top sub, the upper mandrel support block, if used, and the lower mandrel support block.

A cylinder sleeve is mounted in surrounding relationship to the adjacent portions of the upper and lower tubular body portions and defines an annular fluid pressure chamber within which an annular piston is reciprocable. Fluid pressure derived from pressurizing the bore of the tubing string is supplied to the annular fluid pressure chamber through a port system built into the top sub and a longitudinally extending pipe. Such application of fluid pressure first severs shear elements which are provided to hold the components of the packer in their run-in positions, and then effects an upward movement of the cylinder, thus compressing the compressible packing elements against an annular stop block or packing element retainer secured to the top portions of the upper tubular body portion. Concurrently, the downward motion of the annular piston effects a downward movement of an upper cone element and forces the slips downwardly toward engagement with the lower cone element and thus effects the radial expansion of the slips into biting engagement with the conduit wall. A conventional body lock ring is provided which is operative between the piston and cylinder to hold these elements in their expanded positions.

Thus, the packer may be set at any desired location within the well conduit and the mandrel bore is in fluid communication between the tubing string at its upper end and a lower tubing string or other connection to a submersible pump at its lower end. The electrical conduit for driving the pump is disposed in sealed relationship with respect to the eccentric passage provided for it in the top sub and thus does not in any manner permit fluid passage around the conduit to bypass the packing elements.

The aforedescribed packer may be conveniently unset and retrieved from the well by an upward movement of the tubing string, resulting in an upward movement of the top sub, and hence of the mandrel. Such upward movement effects the shearing of the shear ring provided between the top sub and the upper tubular body so that both the top sub and the mandrel may be shifted upwardly relative to the upper and lower tubular bodies. To reduce the size of the shear ring, a supplementary restraint is provided by a C-ring biased to a locking position by pistons responsive to any differential between tubing pressure and annulus pressure.

The upward movement of the bottom end of the mandrel effects an upward movement of the lower support block and moves it out of engagement with the locking heads of the collet which secures the lower cone to the lower tubular body portion, thus releasing the slips. Further upward movement of the mandrel will bring the lower support block into engagement with an internal shoulder on the lower tubular body and effect upward movement of the lower tubular body portion, the body connector sub and the upper tubular body portion. Such upward movement effects the release of compressive force on the elastomeric packing elements, permitting them to collapse to their unset positions and, of course, the upper and lower slip cones are removed from engagement with the slips, permitting release of the packer from the conduit wall. The lower slip cone is carried upwardly with the body portions of the packer by an inwardly projecting shoulder provided on the slip cage which is secured to the upper cone and extends downwardly in surrounding relationship to the lower cone. Thus, the entire packer assemblage is returned to its unset position and can be retrieved from the well.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
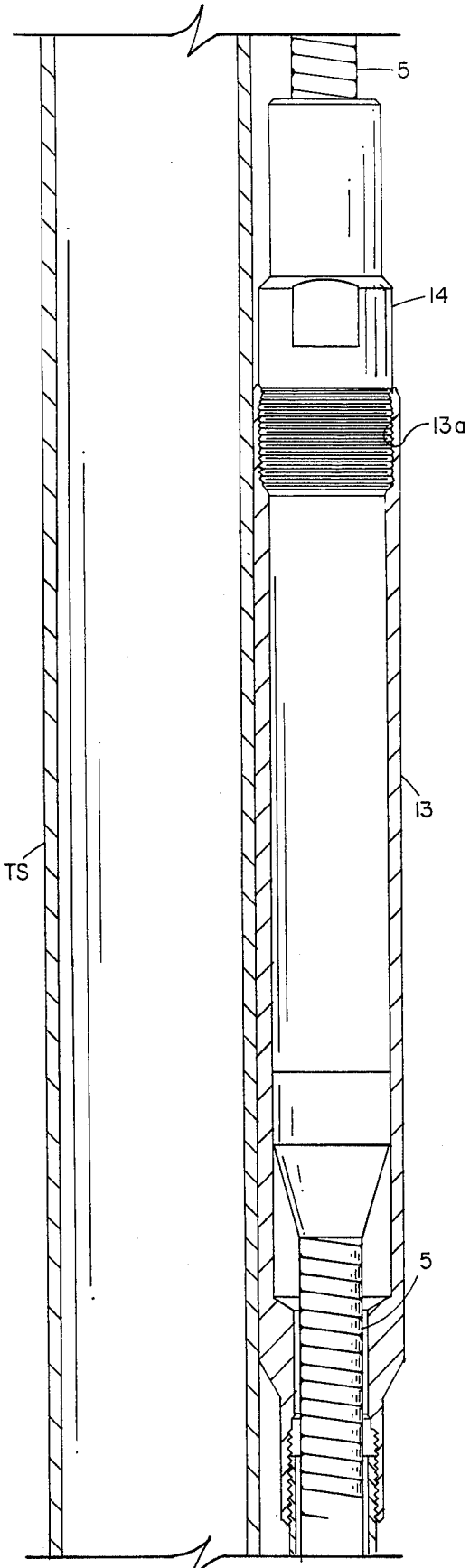
FIGS. 1A, 1B, 1C, and 1D collectively constitute vertical sectional views of a packer embodying this invention, with the elements of the packer shown in their run-in positions. These figures are taken on the planes 1—1 of FIG. 4.
Figure 1B:
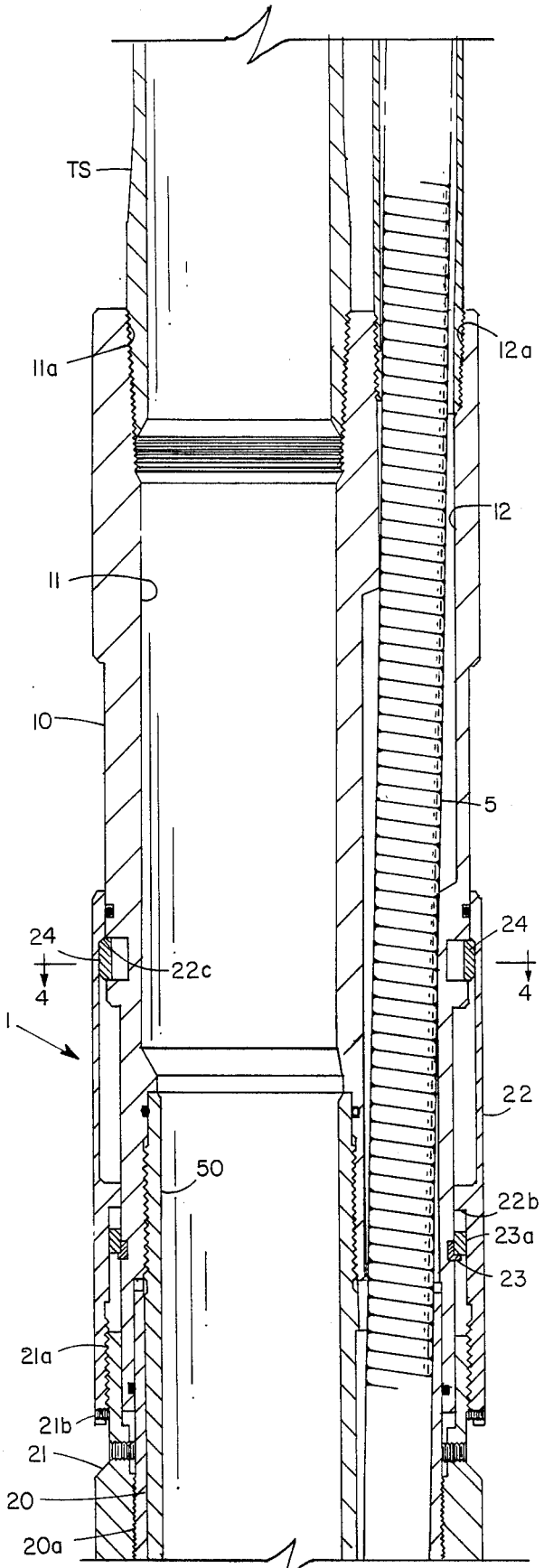
Figure 1C:
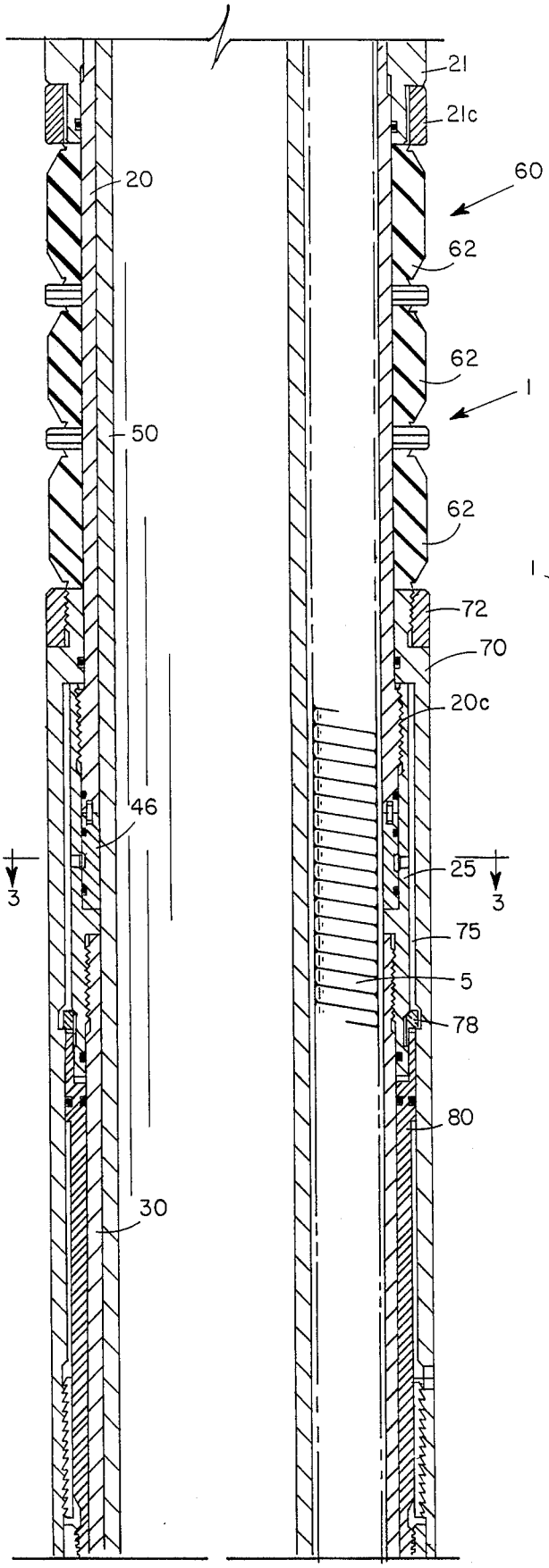
Figure 1D:
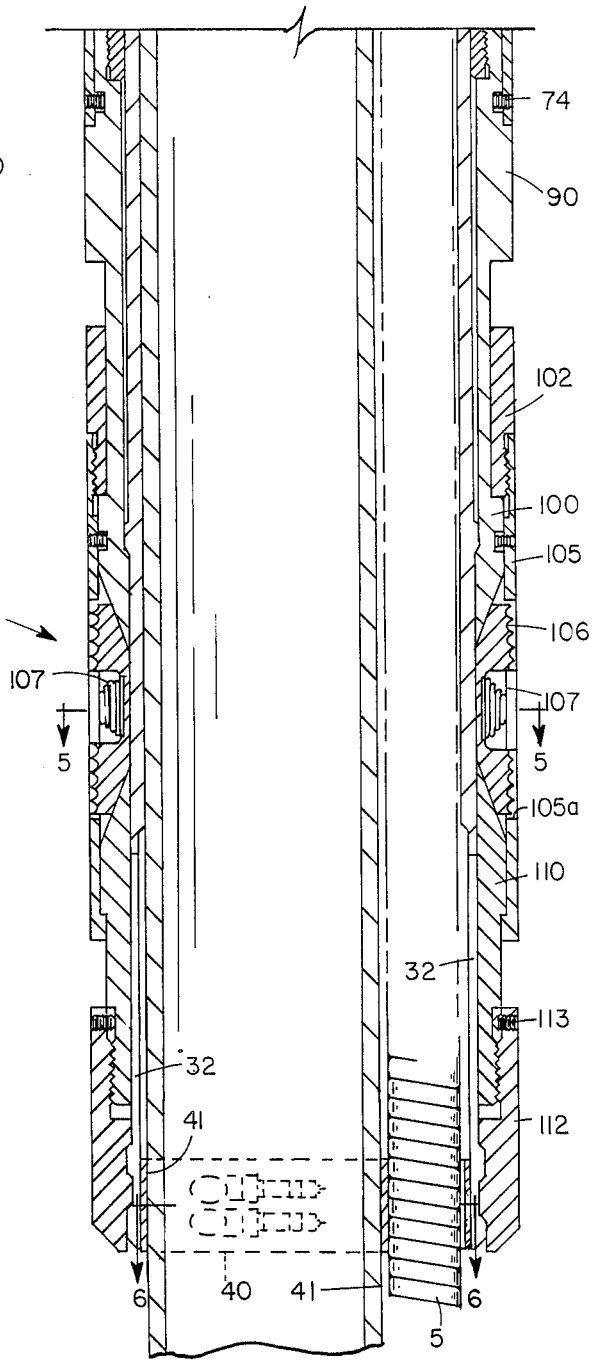

Referring to the drawings, packer 1 embodying this invention comprises a threaded assemblage of a top sub 10, an upper tubular packer body portion 20, a connecting body portion 25, a lower tubular packer body portion 30, a lower support ring 40, and a hollow mandrel 50 connected intermediate the top sub 10 and the lower tubular support ring 40. Top sub 10 has a generally cylindrical exterior configuration and is traversed by two eccentric longitudinal passages 11 and 12. Passage 11 is sized to accommodate a mandrel having a bore equal to that of the tubing string TS to which the top sub is threadably attached as by threads **11*a*. Mandrel 50 is sealably secured in passage 11 by threads 11*a* and O-ring 11*c*. Thus, the bore of the hollow mandrel 50** is in communication with the bore of the tubing string TS.

The other eccentric longitudinal bore 12 in the top sub 10 is provided with internal threads **12*a* for mounting an electrical conduit guide tube 13. As shown only in FIG. 1A, the guide tube 13 extends upwardly and is radially enlarged at its upper portion and provided with threads 13*a* within which a conventional sealed coupling 14 is mounted for sealably mounting an electrical conduit 5 within the bore of guide tube 13. Conduit 5 extends throughout the entire length of the packer in generally parallel relationship to the mandrel 50 and passes through an eccentric hole 42 provided in the bottom support block or ring 40. Support ring 40 is further provided with an eccentric passage 41 for securement to the bottom end of the mandrel 50** in a manner to be hereinafter described.

Figure 2A:
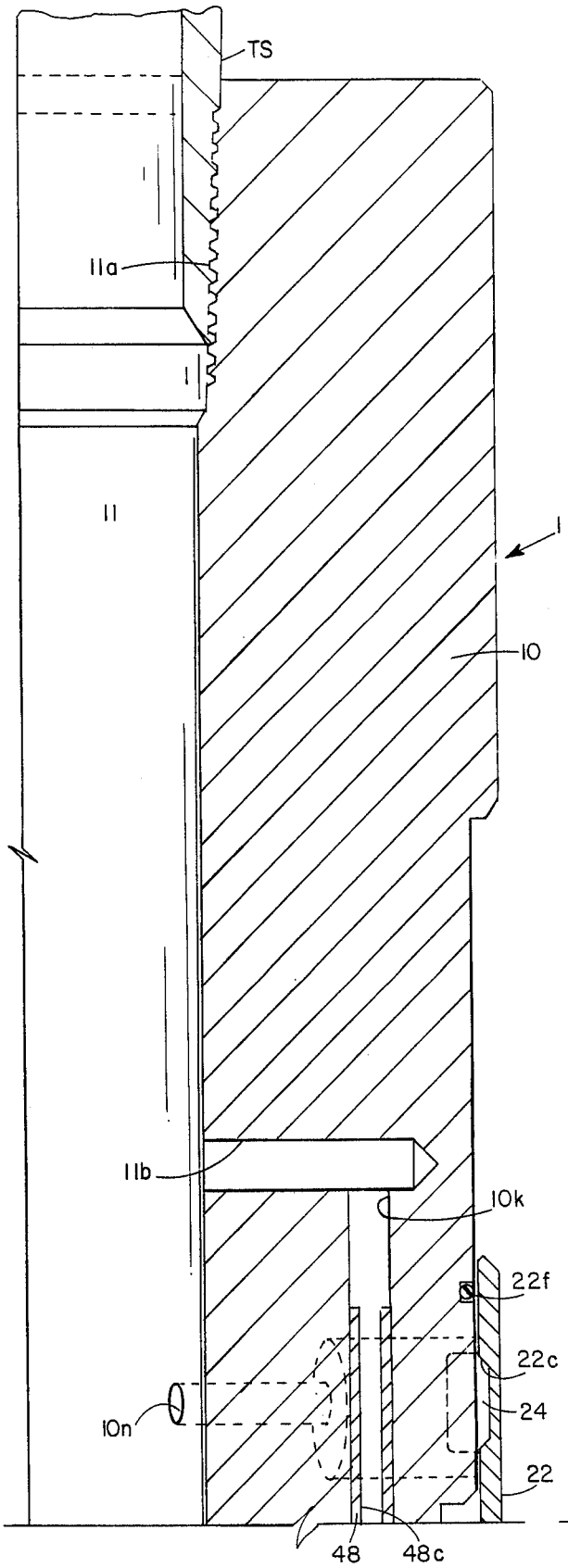
FIGS. 2A, 2B, 2C, 2D, 2E and 2F collectively constitute an enlarged scale vertical sectional view of the packer embodying this invention, with the elements thereof shown in their run-in position. These figures are taken on the planes 2—2 of FIG. 4.
Figure 4:
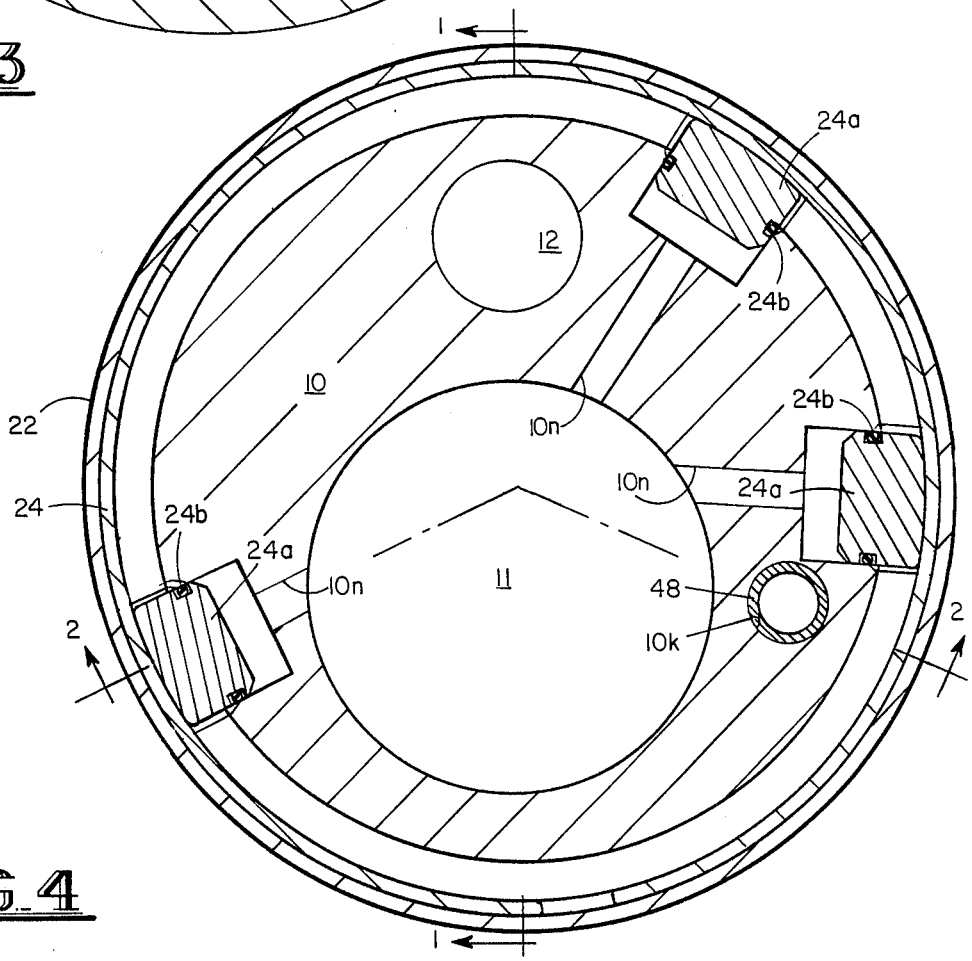
FIG. 4 is an enlarged scale sectional view taken on the plane 4—4 of FIG. 1B.
Figure 5:
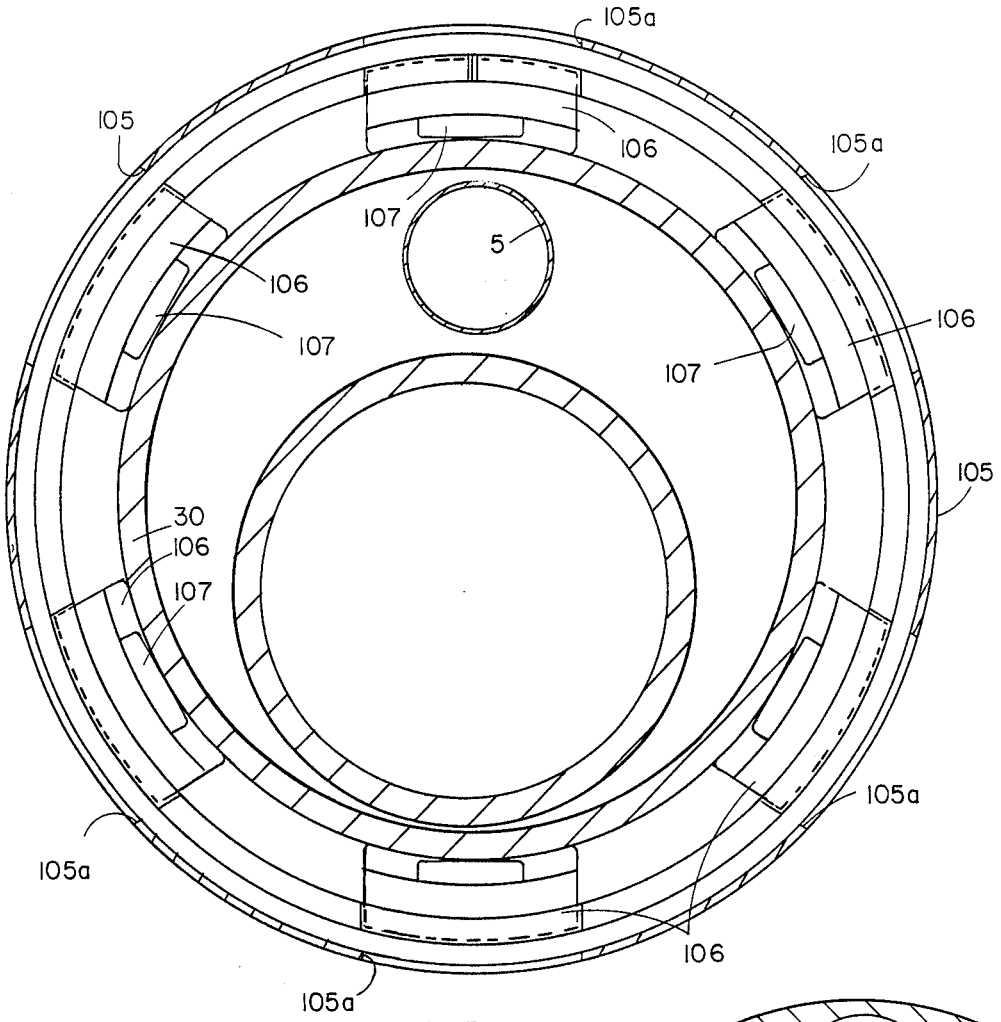
FIG. 5 is an enlarged scale sectional view taken on the plane 5—5 of FIG. 1D.

The upper tubular body portion 20 is provided with external threads **20*a* adjacent its upper end which threadably mount an abutment sleeve 21. The top end of sleeve 21 is of reduced diameter and provided with external threads 21*a* which are secured to a coupling sleeve 22. Set screw 21*b* secures this threaded connection. Coupling sleeve 22 is detachably secured to the bottom end of the top sub 10 by two separate elements. The first element is an annular shear ring 23 which is mounted in a suitable groove in the outer periphery of the top sub 10 and engages a ring 23*a* which in turn engages an inwardly projecting shoulder 22*b* provided on the coupling sleeve 22 after limited upward movement of the top sub 10 relative to the upper tubular body portion 20. Additionally, the coupling sleeve 22 defines at its extreme upper end an inwardly projecting annular shoulder 22*c* which is engaged by a C-ring 24 which is urged outwardly by plurality of peripherally spaced locking pistons 24*a* (FIG. 4) having O-rings 24*b*. Pistons 24*a* are conventionally mounted in the top sub 10 and are biased outwardly to hold C-ring 24 in locking engagement with coupling sleeve 22 by fluid pressure derived from tubing string TS by ports 10*n* within the packer body portion 24*a*. Seal 22*f* prevents entry of well debris and the outer faces of the locking pistons 24*a* are exposed to annulus pressure. When fluid pressure within the tubing string exceeds the annulus pressure, the locking pistons 24*a* will urge C-ring 24 outwardly to its locked position. When such pressures are equalized, the locking pistons 24*a* will be shifted inwardly by the C-ring 24 and thus C-ring 24 contracts to an unlocking position. Hence, the top sub 10 cannot be disconnected from the upper tubular body if the pressure within the tubing string exceeds the annulus pressure. Pistons 24a and C-ring 24 are shown in their locked positions in FIGS. 1A and 2A**.

Upper tubular packer body portion 20 is provided with external threads 20c adjacent its lower end and such threads are threadably engaged by the upper portion of the body connector sub 25. This threaded connection is sealed by an O-ring 20d. The lower end of the body connector sub 25 is provided with internal threads 25a and secured to the top end of the lower tubular body 30. This threaded connection is sealed by O-ring 25b. Thus the upper tubular body 20, the connecting body sub 25 and the lower tubular body 30 form a continuous tubular packer body around which all of the packing elements of the packer, including both slip elements and elastomeric sealing elements are mounted, together with a piston and cylinder apparatus for effecting the expansion of the slips and the sealing elements to set the packer.

The sealing elements 60 comprise a plurality of annular elastomeric members 62 which are respectively separated by conventional annular spacers 64. The upper end of the uppermost annular elastomeric element 62 abuts the lower end of the abutment sleeve or ring 21. A gage ring 21c is mounted on external threads 21d to the bottom of the abutment ring 21 to minimize extrusion of the elastomeric seal material around the abutment ring 21. The bottom face of the lowermost elastomeric sealing element 62 abuts the top face of a cylinder sleeve 70. Sleeve 70 is provided with external threads 70a at its upper end to mount a gage ring 72 thereon to minimize extrusion of the elastomeric seal material. The lower portion of the cylinder sleeve 70 defines an annular chamber 75 surrounding the tubular connecting body 25. Such chamber extends beyond the bottom end of the tubular connecting sub 25 to surround the top end of the lower body portion 30. In the chamber 75, an annular piston 80 is slidably and sealably mounted. An O-ring 70b seals the joint between the top of cylinder sleeve 70 and the lower portion of the upper tubular body 20. The lower end of the cylinder sleeve 70 is secured by a plurality of shear screws 74 which engage an annular groove 90a provided on the exterior of a connecting sub 90.

A sealable mounting of the piston 80 within the fluid pressure chamber 75 is accomplished by internal and external O-rings 80a and 80b respectively mounted in internal and external grooves formed in the upper end of the piston 80. The lower end of piston 80 is provided with wicker threads 82 which cooperate with a conventional body lock ring 84 which is mounted between the wicker threads 82 and internal rachet threads 76 formed on the lower interior portion of the cylinder sleeve 70.

During run-in, and in the absence of fluid pressure being supplied to the fluid pressure chamber 75, the cylinder sleeve 70 is latched to the connecting body portion 25 by an annular C-ring 78 which cooperates with an external recess 25d formed on the connecting body portion 25 and an internal recess 70d formed on the inner wall of the cylinder sleeve 70. So long as the C-ring 78 is in a contracted position, the cylinder sleeve 70 is locked to the tubular body assemblage of the packer. C-ring 78 is held in the contracted position by an annular extension 80e formed on the extreme upper portion of piston 80. Following initial movement of the piston 80 in a downward direction, the extension 80e rides off the locking C-ring 78 and permits the release of the cylinder sleeve 70 from the tubular body assemblage of the packer.

The connecting sub 90 is connected to the bottom of piston 80 by threads 90e and is provided with internal threads 90b by which it is secured to the top end of an upper cone 100. This threaded connection is secured by set screw 90c. Upper cone 100 is provided with an upwardly facing annular shoulder 101 to which is secured a slip cage mounting sleeve 102 having external threads 103 for threadably engaging the top portions of a conventional slip cage 105. Shear pins 104 hold the upper cone element 100 in its run-in position. Slip cage 105 is provided with a plurality of peripherally spaced slots 105a within which are conventionally mounted a plurality of slips 106. Compression springs 107 urge the slips radially inwardly. Slips 106 are provided with an upwardly facing inclined surface 106a which cooperates with a downwardly facing inclined surface 100a formed on the bottom of the upper slip 100 and a downwardly facing inclined surface 106b which cooperates with an upwardly facing surface 110a formed on the top portion of a lower cone 110. Thus, upward motion of lower cone 110 relative to upper cone 100 will produce a radial expansion of the slips 106 into biting engagement with the casing wall, in a manner well known in the art.

The lower extremity of bottom cone 110 is provided with external threads 111 to which is secured a lower cone locking sleeve 112. A set screw 113 secures the threaded connection. It should also be noted that the extreme bottom end of slip cage 105 is provided with an inwardly projecting shoulder 105e which engages a downwardly facing shoulder 110d on the lower cone 110 to effect the removal of the lower cone 105 when retrieval of the packer is desired.

Figure 6:
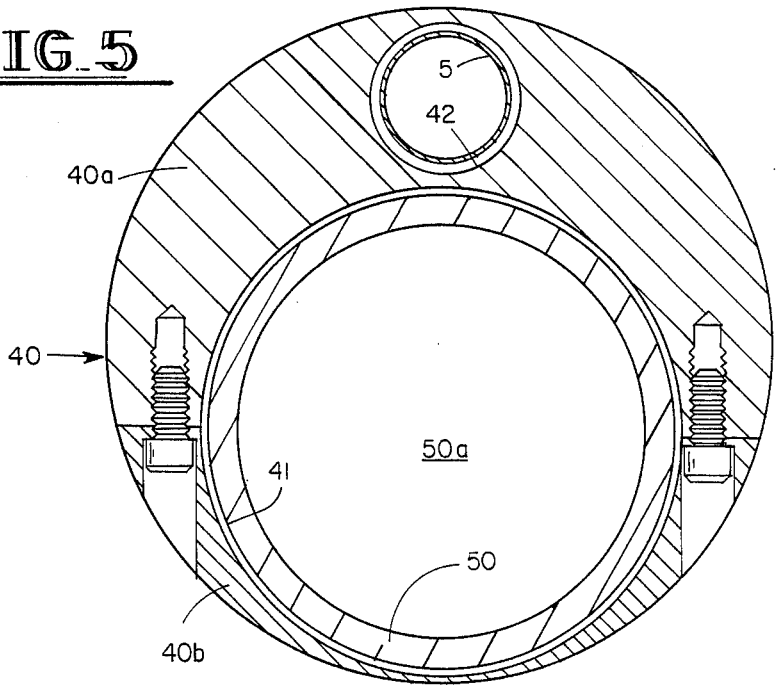
FIG. 6 is an enlarged scale sectional view taken on the plane 6—6 of FIG. 1D.

The lower cone locking sleeve 112 is provided with a pair of internal annular recesses 112a. The extreme lower portions of the lower tubular body portion 30 is formed as a plurality of peripherally spaced collet arms 32 having enlarged locking head portions 32a formed on the bottom ends thereof. The locking head portions 32a are held in locking engagement with the recesses 112a by the lower cylindrical support 40. As best shown in FIG. 6, the lower cylindrical support 40 is of cylindrical configuration defining a large eccentric bore 41 to receive mandrel 50, and a smaller eccentric bore 42 to receive conduit 5. Bore 42 is receivable within an annular external recess formed on the bottom end of the mandrel 50. Cylindrical support 40 is formed in two pieces 40a and 40b which are interconnected by bolts 40c and thus clamped to mandrel 50.

Figure 3:
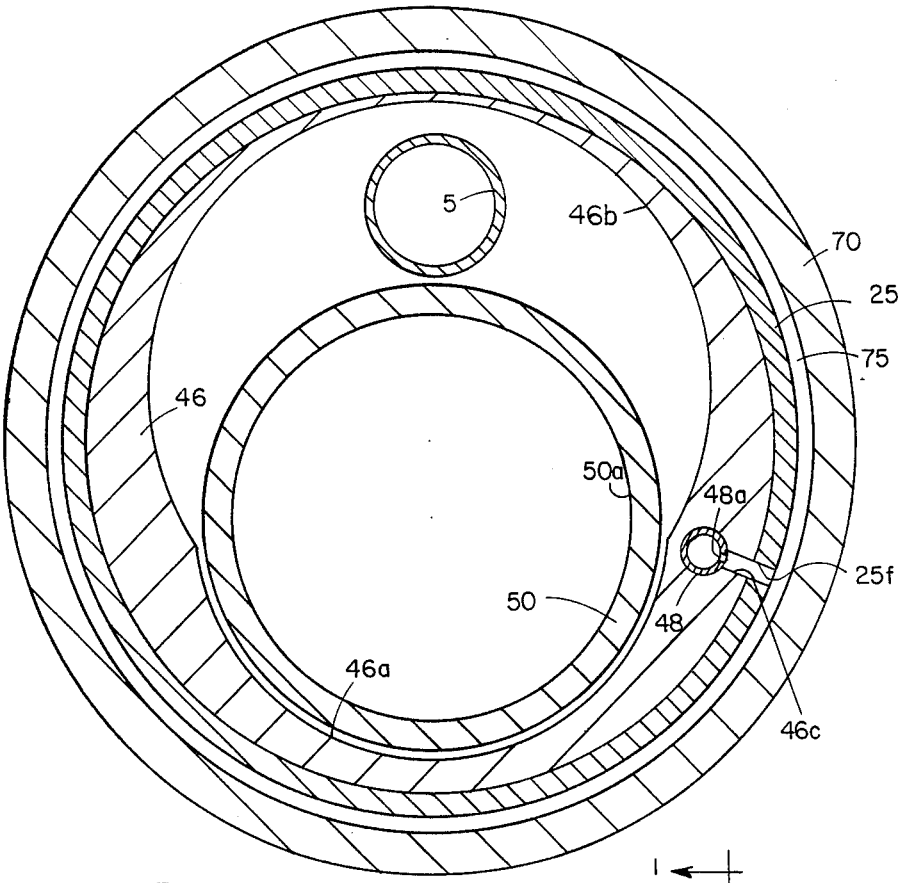
FIG. 3 is an elarged scale sectional view taken on the plane 3—3 of FIG. 1C.

From the description thus far, it is apparent that the mandrel 50 and the electrical conduit 5 are sealably secured within the tubular packer body assemblage. If the length of the packer dictates that additional lateral support be provided for the mandrel 50 and the electrical conduit 5, such support may be provided through the insertion of an upper cylindrical support member 46. Support member 46 (FIG. 3) has a large eccentric aperture 46a contoured to receive the exterior of the mandrel 50 and another connecting aperture 46b to receive the electrical conduit 5.

Upper support 46 is preferably mounted intermediate the bottom end of the upper tubular body 20 and an upwardly facing surface 25e formed on the connecting tubular body 25. As best shown in FIG. 2C, the upper support ring 46 provides a fluid passage 46c for directing tubing pressure to the interior of the fluid pressure chamber 75. Such fluid passage also comprises a radial port 25f in the wall of the tubular connecting housing 25 which is sealed off by a pair of O-rings 46f and 46g provided on the periphery of the support ring 46. An upwardly extending pipe 48 is threaded by threads 46e into upper support ring 46. Pipe 48 is provided with a plurality of radial apertures 48a which communicate with the radial port 46c through an annular recess 48d. O-rings 48b on the exterior of pipe 48 seal off the connection between ports 48a and 46c.

Figure 2B:
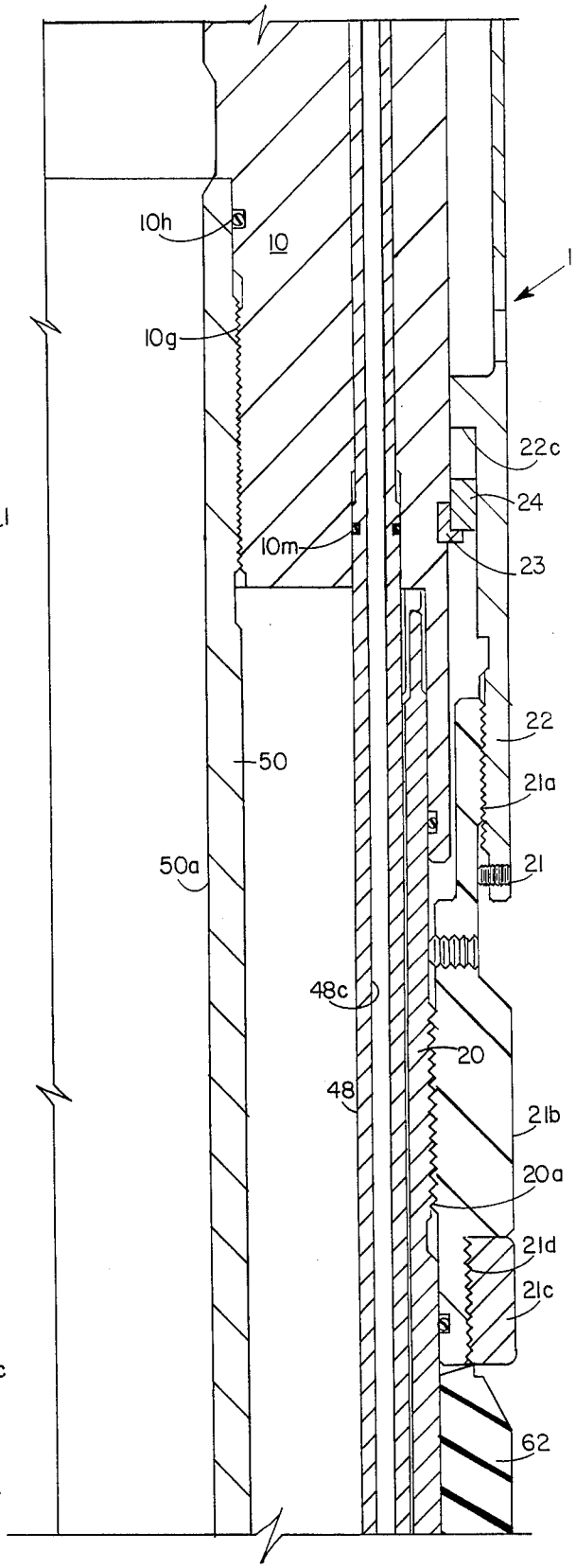
Figure 2C:
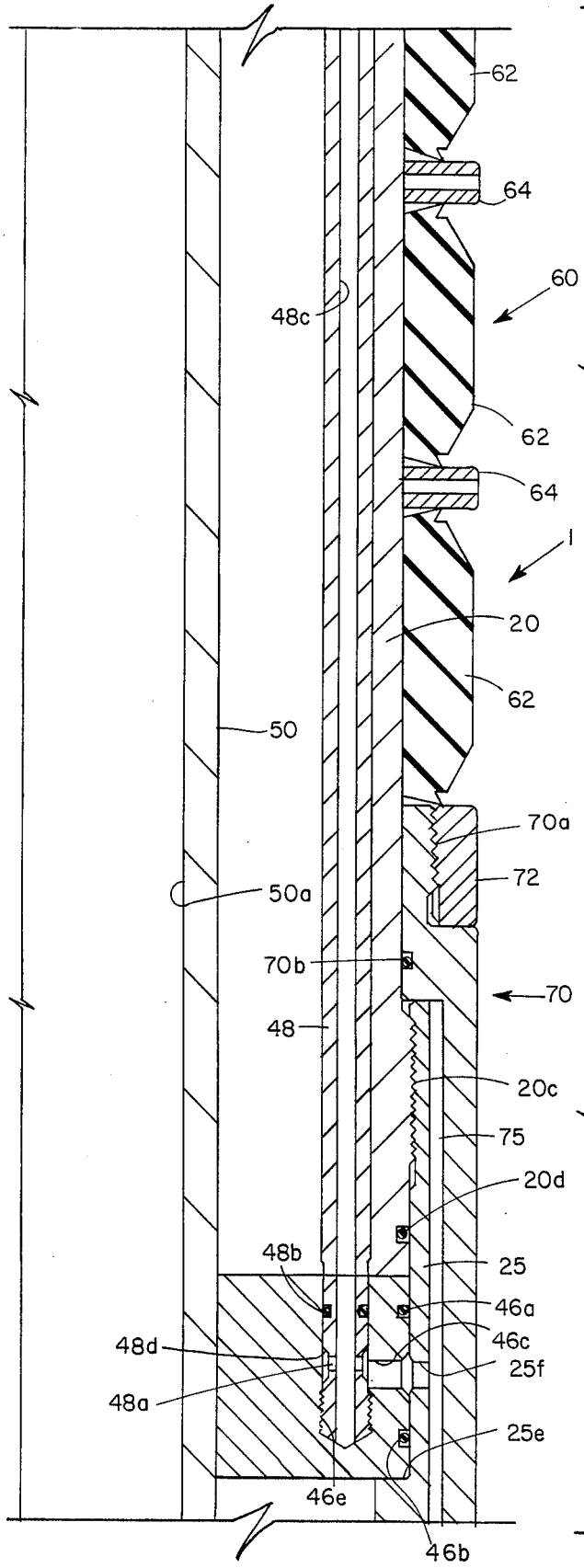
Figure 2D:
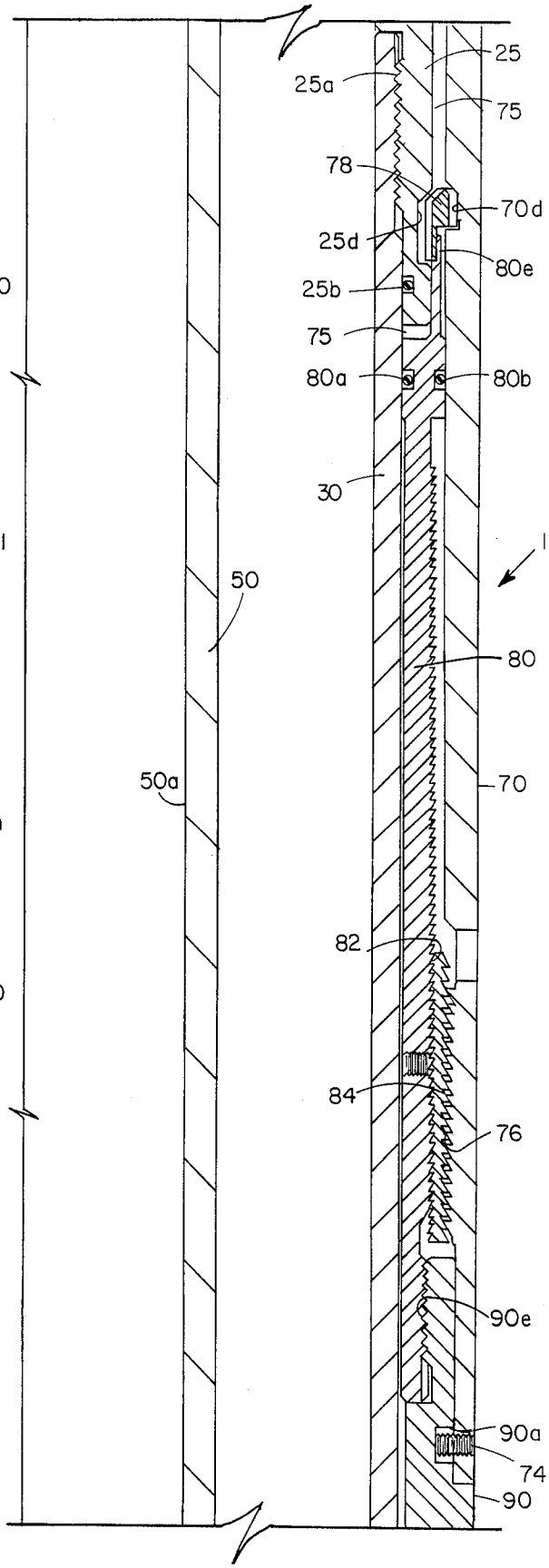
Figure 2E:
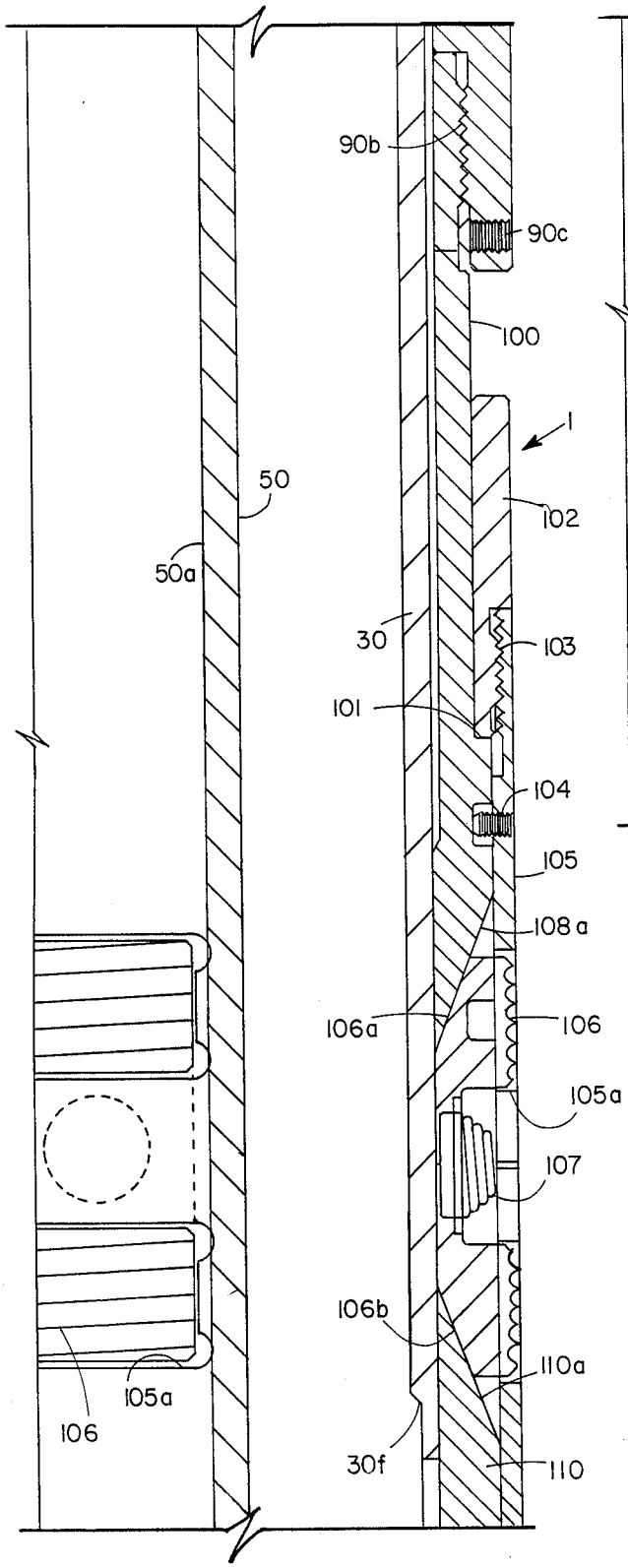
Figure 2F:
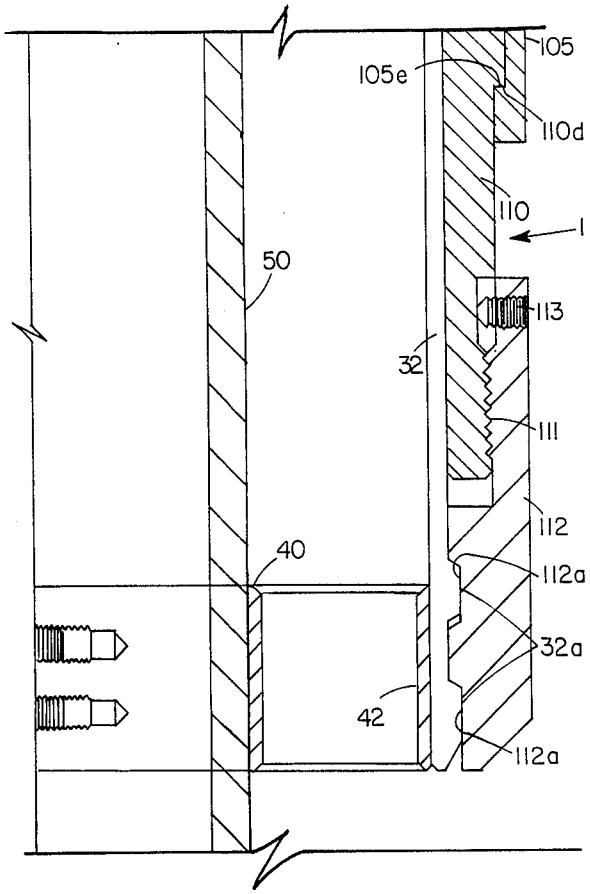

The upper end of fluid transmission pipe 48 is sealably mounted in a hole 10k opening in the bottom end of the top sub 10 by an O-ring 10m (FIG. 2B). The bore 48c of the fluid transmission pipe 48 is thus in fluid communication with a radial port 11b extending outwardly from the bore 11 of the top sub 10. Thus, tubing pressure may be supplied through the fluid transmission pipe 48, the radial port 48a, radial port 46c, radial port 25f and then into the fluid pressure chamber 75 to actuate the annular piston 80.

From the foregoing description, the operation of the packer with electrical conduit bypass will be readily apparent to those skilled in the art. The packer is run into the well to a desired position with the components thereof located in the positions shown in FIGS. 2A–2E. If the bore of the mandrel is not closed by an electric pump (not shown) which is suspended from the bottom end of the mandrel, then a conventional plug is set by wireline within the bottom end of the mandrel 50 or a tubing string depending therefrom. Thus, fluid pressure within the bore of the tubing string can be increased and such increased fluid pressure passes through the radial port 11b and into the bore 48c of the fluid transmission pipe 48. From the pipe 48, it passes into the fluid pressure chamber through the aligned ports 48a, 46c and 25f into the upper end of the fluid pressure chamber 75. Such fluid pressure acts on the top end of the piston 80 to move the piston downwardly slightly, thus releasing the C-ring latch 78 between the cylinder sleeve 70 and the connecting tubular body portion 25. Also, the shear screws 74 at the bottom end of the cylinder sleeve 70 will be sheared, thus leaving the cylinder sleeve 70 free to move upwardly to compress the elastomeric packing assemblage 60 while the piston 80 moves downwardly to effect the setting of the slips 106 by downward movement of the upper cone 100 relative to the lower cone 110. Hence the packer is set in the desired position in the subterranean well and the electrical conduit 5 bypasses the packer without in any manner interfering with the flow area for the tubing string which passes through the bore 11 of the top sub 10 and the bore 50a of the mandrel 50.

When it is desired to release the packer, the annulus pressure is equalized with the pressure within the packer body or vice versa so no pressure differential exists between the inside and the outside of the tool. This releases C-ring 24. An upward force is then applied to the tubing string TS which results in an upward force being transmitted to the top sub 10 to effect the shearing of shear ring 23, thus freeing the top sub 10 and the connected mandrel 50 for upward movement with the tubing string. Limited upward movement of the mandrel 50 effects the upward displacement of the lower support ring 40 to permit the locking collet heads 32a to move inwardly and release from the recessses 112a in the lower cone locking sleeve 12. This permits the lower cone 110 to release and, the continued upward movement of the top sub 10 and mandrel 50 brings the top face of the lower support ring 40 into engagement with the downwardly facing shoulder 30f (FIG. 2E) provided on the interior of the lower tubular body portion 30. The slip cage 105 is, of course, moved upwardly with the upper slip 106 and the inwardly projecting shoulder 105e on the bottom of the slip cage 105 engages a downwardly facing surface 110b formed on the lower slip 110 to effect the removal of the lower slip with the remainder of the packer elements.

If desired, more than one bypass passage for electrical conduit, control fluid pipes, etc. may be accommodated by the provision of additional eccentric apertures in top sub 10 and upper and lower support rings 46 and 40 to receive such additional bypass elements and appropriate seals for such additional bypass elements.

It should be noted that the provision of the piston biased C-ring 24 permits a substantial reduction in size of annular shear ring 23, since upward fluid pressure forces on the mandrel 50 and top sub 10 are absorbed by the piston biased C-ring 24.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A packer for a subterranean well conduit providing an electrical conduit bypass through the packer comprising, in combination: a top sub having a cylindrical exterior configuration and defining a plurality of eccentrically disposed longitudinal passages; one said passage having upper and lower ends and having means at its upper end for connection to a tubing string; another of said passages being designed to accommodate an electrical conduit; means for sealingly inserting said electrical conduit through said another of said passages; a tubular packer body assemblage; shearable means for securing the upper end of said tubular body assemblage to the bottom end of said top sub; annular packing means surrounding one part of said tubular body assemblage; an abutment ring secured to said tubular body assemblage adjacent one axial end of said annular packing means; said packing means being expandable into sealing engagement with the well conduit bore by axial compression thereof against said abutment ring; a plurality of peripherally spaced slip elements surrounding another part of said tubular body assemblage; axially shiftable upper and lower cone elements cooperable with said slip elements to expand same into engagement with the well conduit bore; a cylinder sleeve cooperable with said tubular body assemblage to define an annular fluid pressure chamber; an annular piston cooperating with said annular fluid pressure chamber; port means in said top sub and said tubular packer body assemblage for supplying pressured fluid from the tubing string to said annular fluid pressure chamber; means operatively connecting said cylinder sleeve and said annular piston to said packing means and said upper cone element to packoff the packer in the well conduit; a hollow mandrel secured to the bottom end of said one of said passages and extending downwardly through said tubular body assemblage; an upper cylindrical support ring mounted in the bore of said tubular packer body assemblage; said upper support ring having eccentric passages to receive said mandrel and the electrical conduit therein; a lower cylindrical support ring; means for securing said lower support ring to said mandrel adjacent to and concentric with said lower cone element; said support ring defining an eccentric passage to accommodate an extension of the electric conduit, whereby only said top sub and said cylindrical support rings have to be revised to accommodate any selected sizes of said mandrel and the electrical conduit.

2. The apparatus of claim 1 wherein the bottom end of said packer tubular body assemblage comprises a collet having a plurality of peripherally spaced locking heads abutting the cylindrical periphery of said support ring; and recessed means secured to said lower cone element lockingly receiving said collet heads, thereby securing said lower cone element to said tubular body assemblage until said top sub and said mandrel are elevated relative to said tubular body assemblage.

3. The apparatus of claim 1 or 2 further comprising an interlocking means disposed in locking relation between said cylinder sleeve and said annular piston to secure same in an inactive position relative to said annular packing means and said upper cone element during run-in, said interlocking means being releasable by initial movement of said annular piston produced in response to introduction of said pressured fluid into said fluid pressure chamber, thereby driving said cylinder sleeve and said annular piston in opposite directions to an extended position wherein said packing means and said slip elements are expanded into engagement with the well conduit.

4. The apparatus of claim 1 or 2 further comprising an interlocking means disposed in locking relation between said cylinder sleeve and said annular piston to secure same in an inactive position relative to said annular packing means said upper cone element during run-in, said interlocking means being releasable by initial movement of said annular piston produced in response to introduction of said pressured fluid into said fluid pressure chamber, thereby driving said cylinder sleeve and said annular piston in opposite directions to an extended position wherein said packing means and said slip elements are expanded into engagement with the well conduit; and body lock ring means for securing said cylinder sleeve and annular piston in said extended position.

5. The packer of claim 1 further comprising a downwardly facing shoulder formed in said packer tubular body assemblage and engagable by said lower cylindrical support ring by further upward movement of said mandrel, thereby removing said tubular body assemblage and all of the aforesaid elements mounted thereon from the well conduit after shearing said shearable means.

6. The packer of claim 5 further comprising fluid pressure operated means for locking said top sub to said tubular body assemblage, said fluid pressure operated means being biased to a locking position by a higher fluid pressure inside said top sub than the pressure in the well conduit bore; and resilient means urging said fluid pressure operated means to an unlocked position.

7. The packer of claim 1, 5 or 6 wherein said tubular packer assemblage comprises upper and lower tubular bodies; and a connecting sleeve threadably interconnecting said upper and lower tubular bodies and securing said upper support ring intermediate thereto.

8. The packer of claim 5 or 6 wherein said tubular packer assemblage comprises upper and lower tubular bodies; and a connecting sleeve threadably interconnecting said upper and lower tubular bodies and securing said upper support ring intermediate thereto; a portion of said fluid pressure chamber overlying said connecting sleeve; and said port means comprises a radial port in said one passage, an axially extending pipe mounted in said top sub and said upper support ring and radial ports in said connecting sleeve and upper support ring communicating with said pipe.

* * * * *